United States Patent [19]

Iorio Peretto

[11] Patent Number: 4,463,531

[45] Date of Patent: Aug. 7, 1984

[54] PROCESS FOR MANUFACTURING A FRAME SUITABLE FOR ENCASING A PORTION OF AN EXTERNAL WALL AND FRAMES OBTAINED THEREOF

[76] Inventor: Sergio Iorio Peretto, Arensod/Sarre (Aosta), Italy, 11010

[21] Appl. No.: 313,197

[22] Filed: Oct. 20, 1981

[30] Foreign Application Priority Data

Oct. 23, 1980 [IT] Italy ..... 25528 A/80
Aug. 4, 1981 [IT] Italy ..... 23363 A/81

[51] Int. Cl.[3] ..... E06B 1/04; E04C 2/30

[52] U.S. Cl. ..... 52/204; 52/264; 52/293; 52/580; 52/595; 52/785

[58] Field of Search ..... 52/293, 234, 264, 656, 52/580, 592, 210, 211, 785, 204, 593, 595

[56] References Cited

U.S. PATENT DOCUMENTS

| | | | |
|---|---|---|---|
| 2,067,403 | 1/1937 | Lea | 52/204 X |
| 2,610,710 | 9/1952 | Shannon | 52/293 X |
| 3,087,586 | 4/1963 | Gray . | |
| 3,397,496 | 8/1968 | Sohns | 52/580 X |
| 3,461,638 | 8/1969 | Balinski | 52/238.1 |
| 3,481,093 | 12/1969 | Davidson | 52/293 |
| 4,037,379 | 7/1977 | Ozanne | 52/580 X |

FOREIGN PATENT DOCUMENTS

| | | | |
|---|---|---|---|
| 484084 | 6/1977 | Australia . | |
| 634498 | 1/1962 | Canada | 52/580 |
| 629018 | 4/1936 | Fed. Rep. of Germany . | |
| 1296494 | 5/1962 | France . | |
| 2097564 | 3/1972 | France . | |
| 1440018 | 6/1976 | United Kingdom | 52/785 |

*Primary Examiner*—Alfred C. Perham
*Attorney, Agent, or Firm*—Wenderoth, Lind & Ponack

[57] ABSTRACT

A frame for use as a portion of an external wall of a building includes an upper horizontal C-shaped section channel member and first and second vertical C-shaped section channel members. Each C-shaped section channel member includes a pair of spaced flanges joined by a web, with end portions of the flanges opposite the web being bent inwardly toward each other to define a mouth. The C-shaped section channel members are rigidly assembled with the first vertical member extending vertically downwardly from a first end of the horizontal member and with the mouth of the first vertical member facing inwardly of the frame, with the second vertical member extending vertically downwardly from the horizontal member at a position spaced longitudinally thereof from the first vertical member and with the mouth of the second vertical member facing outwardly of the frame, and with the mouth of the horizontal member facing upwardly. Vertically spaced stiffener members are positioned between and fixed to the spaced flanges of the vertical members. A pair of Z-shaped section members extend vertically downwardly from and are fixed to the horizontal member at a position adjacent the first vertical member and inwardly thereof. Each Z-shaped member has a flange extending outwardly from a respective face of the frame and having opposite vertical surfaces forming supports to position side edges of cladding panels to cover the faces of the frame.

18 Claims, 19 Drawing Figures

Fig. 2
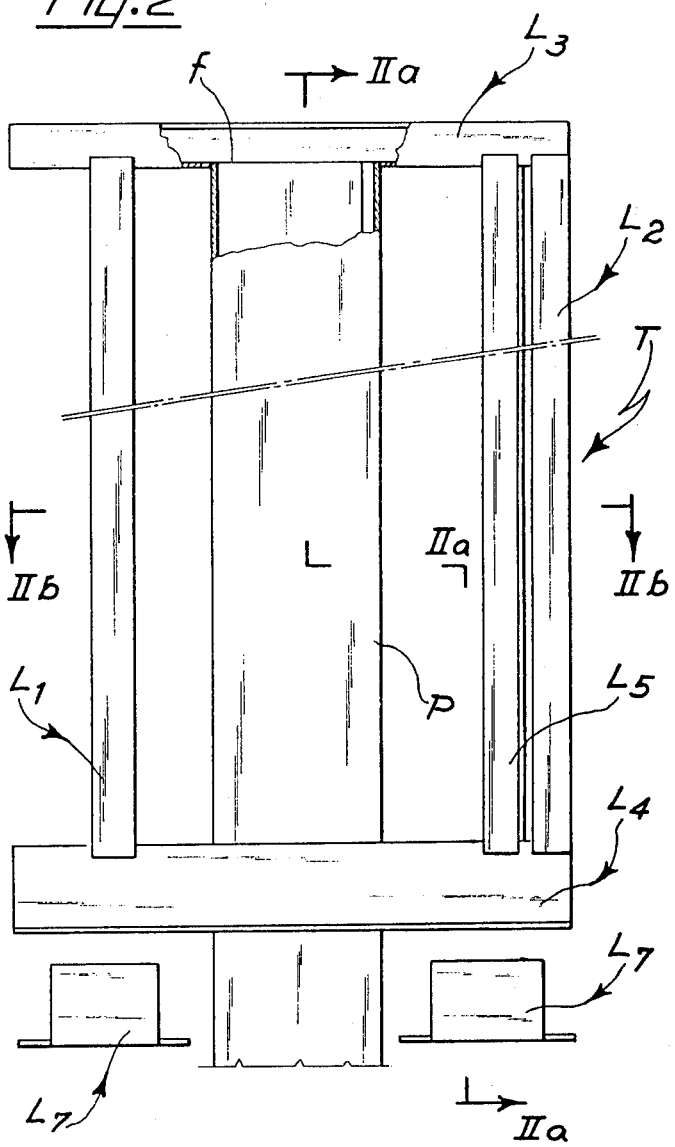
Fig. 2a
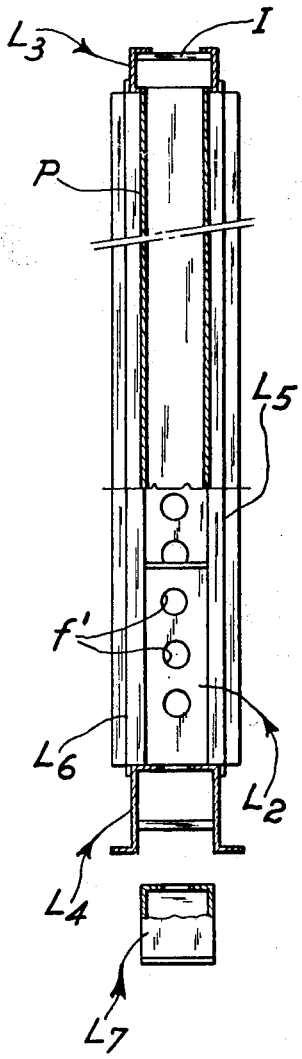
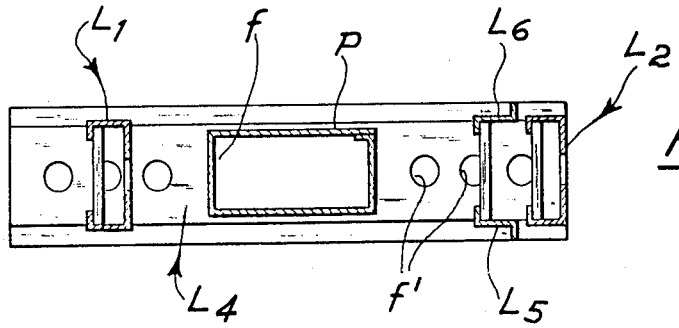
Fig. 2b

Fig. 3
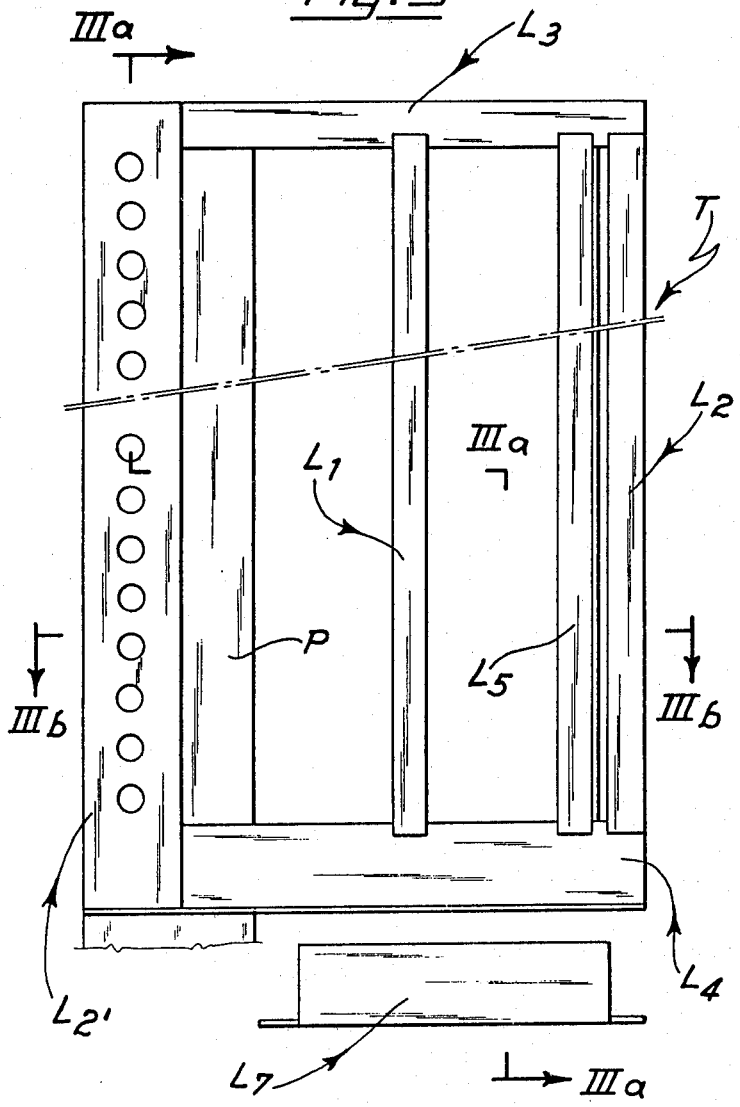
Fig. 3a
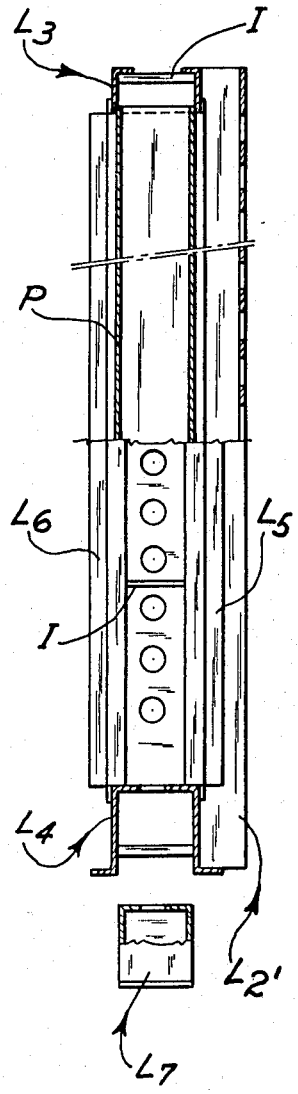
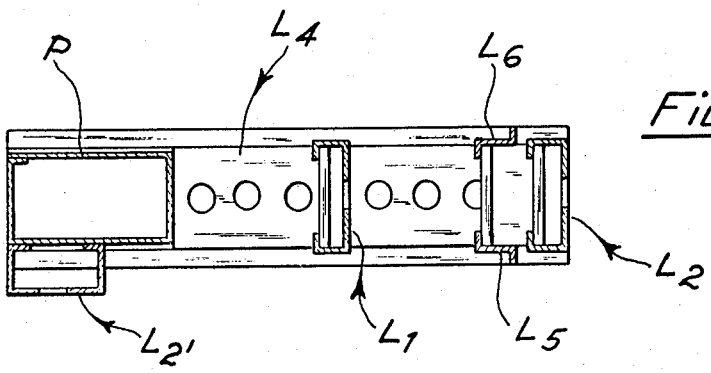
Fig. 3b

PROCESS FOR MANUFACTURING A FRAME SUITABLE FOR ENCASING A PORTION OF AN EXTERNAL WALL AND FRAMES OBTAINED THEREOF

BACKGROUND OF THE INVENTION

This invention relates to a process for manufacturing a frame suitable for encasing a portion of an outside wall with or without a loadbearing structure, and with or without door or window openings. The invention further relates to the frames obtainable therewith.

The progress accomplished through the invention in its particular industrial field is considerable as it is possible, due to the frames being ready prepared in a factory, to proceed to a rapid, rational and reliable construction at the job site of external walls of a building.

They are nowadays any number of manufacturing processes for prefabricating building parts aimed at achieving maximum standardization and therefore economy in structures.

Many of such processes are based on the assembly of modular elements.

However, none of them are, to the best of the inventor's knowledge based on prior and extensive research able to solve all manufacturing problems, whether from static aspects or architectural aspects.

SUMMARY OF THE INVENTION

The process in accordance with the invention allows concrete casting directly into a frame, which by its well defined forms and sizes gives exactly the geometric characteristics of a desired building element.

The frame acts as a form or mold which is then incorporated into the structure. This is unlike the well-known prefabrication systems in which the building process of the elements is obtained by means of fixed, complicated, heavy and expensive forms.

This also is unlike a known casting system with detachable reinforcements, where high labour costs are required for the assembly and disassembly of such reinforcements, and where it is problematic to obtain the exact sizes and consequently volumes required for a given installation.

The frames in question are original, first of all, in that they permit a portion of any external wall (and also partition wall) to be formed by the assembly of two vertical members and two horizontal members of C-shaped channel section so as to form a rectangle.

Secondly, they are original because sheet metal members of which they are made include shorter sides of the C-shaped channel section extending outwardly, except in one of the vertical members where such shorter sides extend inwardly.

Thirdly, they are original because the sheet metal members of which they are made are suitably drilled, that is to say, the wider sides of the C-shaped channel sections are drilled with holes which permit introduction of any type of filling or insulating material into the portion of the wall encased by the frame.

Fourthly, they are characteristic because of the provision of Z-shaped section reinforcements parallel and close to the sides of the narrower flanges of the vertical members, or else extending from such flanges, serving to determine the positioning and fastening of external cladding panels.

Fifthly, the frames in question are original because they also permit encasing of portions of external walls through which can extend a pilaster or pillar when they are provided with suitable rectangular holes on the wider sides of the C-shaped channel section of the horizontal members, as well as encasing portions of external walls incorporating a door and balcony provided the lower horizontal frame member be omitted.

A sixth characteristic of the invention is that of the provision of cavities in the bottom and/or top horizontal members so that they can accommodate soffit beams and/or foundation tracks as the three sides of the C-shaped channel sections are equal in length, and face outwardly, and moreover their edges are bent by 90° outwardly to permit resting on the ground and supporting of the external cladding panels.

These main features and other less important ones concerning the frames which can be obtained by the process in accordance with the invention will be more clearly understood from the following detailed description with reference to the accompanying drawings illustrating some of the preferred embodiments which are to be considered as exemplary of the principles of the invention, and are not intended to limit the invention.

BRIEF DESCRIPTION OF THE DRAWINGS

In such drawings:

FIGS. 2, 2*a*, 2*b* are views similar to FIGS. 1, 1*a*, 1*b*, but they refer to a frame consisting of four members which can be used for encasing a portion of a wall with load bearing structure (pilaster) at the centre line;

FIGS. 3, 3*a*, 3*b* are views similar to FIGS. 2, 2*a*, 2*b* but illustrating a variation of the frame when the pilaster constitutes a corner of the building;

DETAILED DESCRIPTION OF THE INVENTION

Referring now the drawings, each frame T obtainable by the process in accordance with the invention consists of two vertical members $L_1$, $L_2$ and two horizontal members $L_3$, $L_4$ which, when assembled, form a rectangle.

Figure 1:
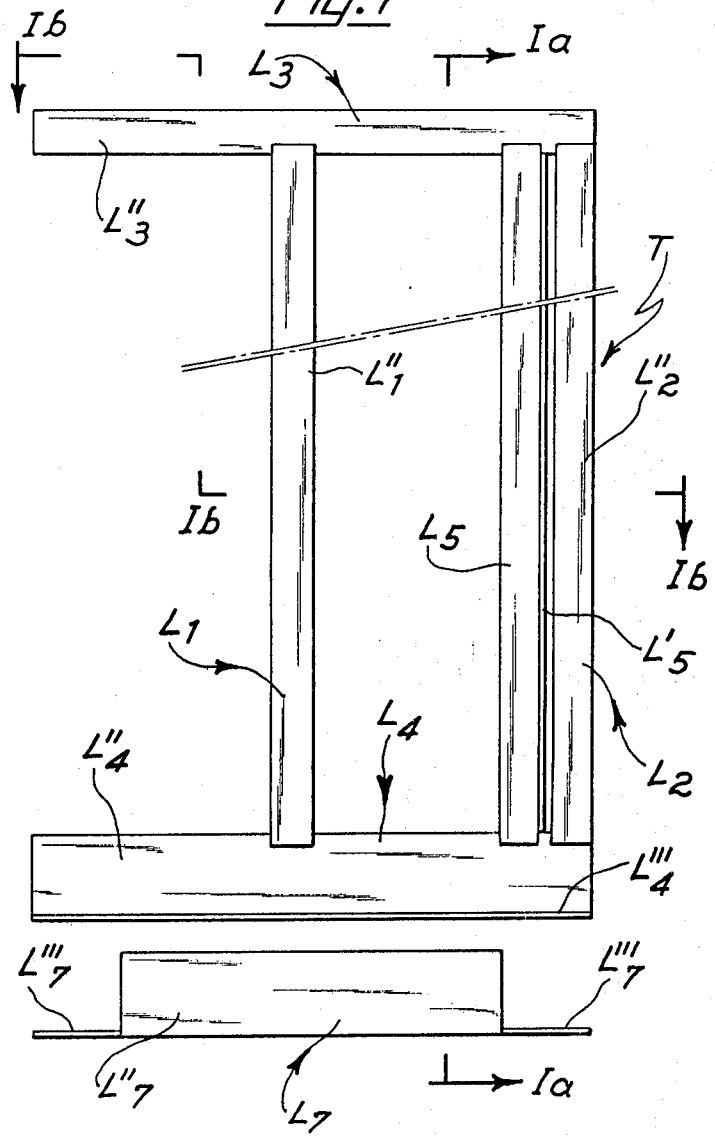
FIGS. 1, 1*a*, 1*b* are a side view and sectional views taken along the lines Ia—Ia and Ib—Ib respectively of FIG. 1 of a four-membered frame obtained with the process in accordance with the invention, which can be used for encasing a portion of a wall without load bearing structure, in which the vertical sheet metal members (or fibre glass reinforced plastic sections) can be positioned at variable distances with respect to each other.
Figure 1A:
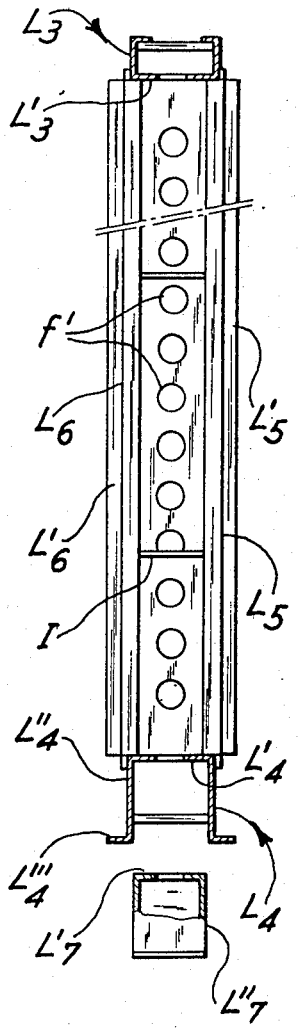
Figure 1B:
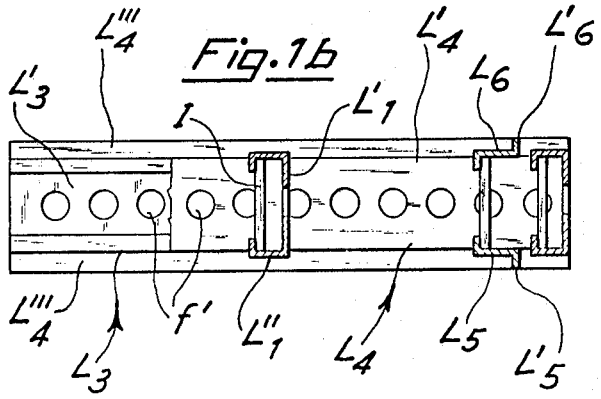
Figure 1C:
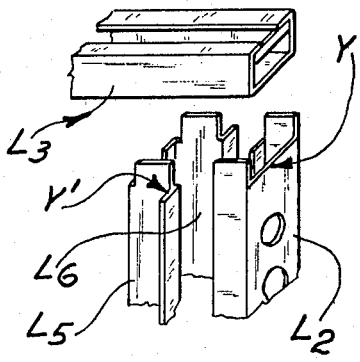
FIG. 1*c* is a perspective view, in enlarged detail, showing the positioning of characteristic Z section reinforcements in the vicinity of a vertical member, as well as a part of a top horizontal member, in order to give a clearer understanding of how such members can be assembled.
Figure 4:
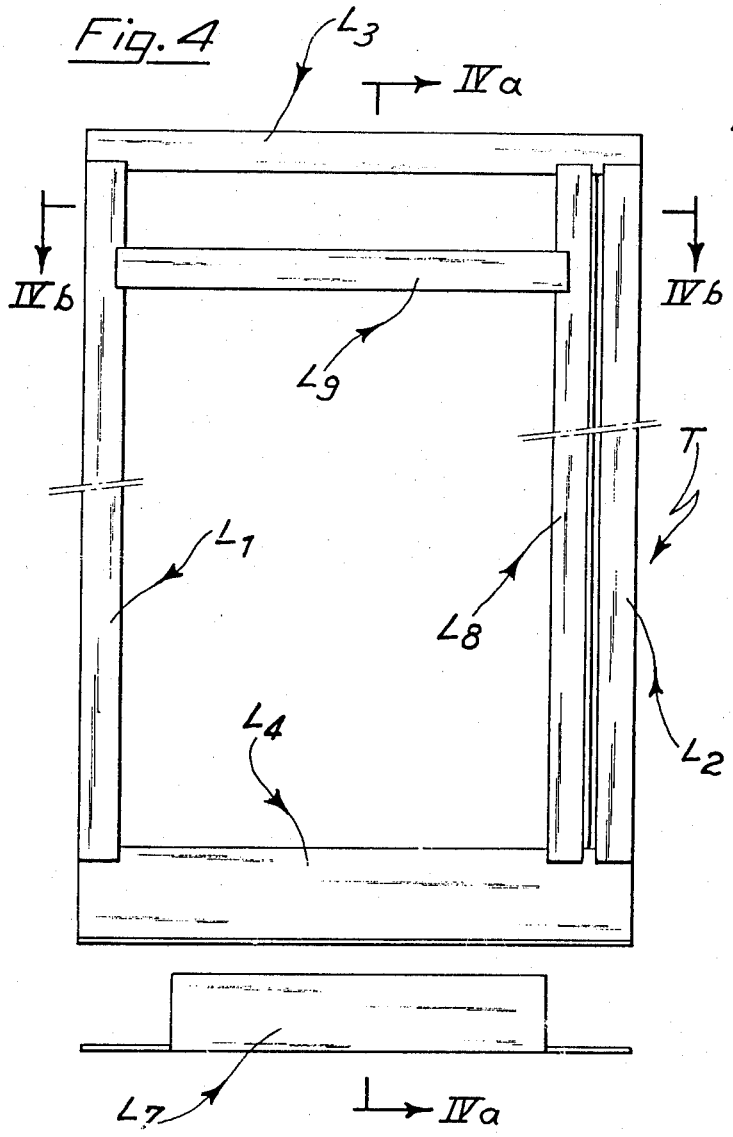
FIGS. 4, 4*a*, 4*b* are a side view and sectional views taken along the lines IVa—Iva and IVb—IVb respectively in FIG. 4 of a frame which, besides having the normal four members, can also have one or more additional vertical and horizontal members (two shown) whose positions are variable with respect to the actual frame according to requirements, and which serve to exactly define the opening for a subframe, such as a window on the outside of the building.
Figure 4A:
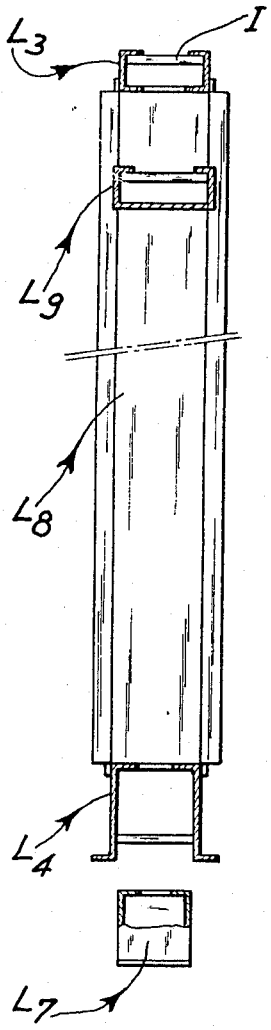
Figure 4B:
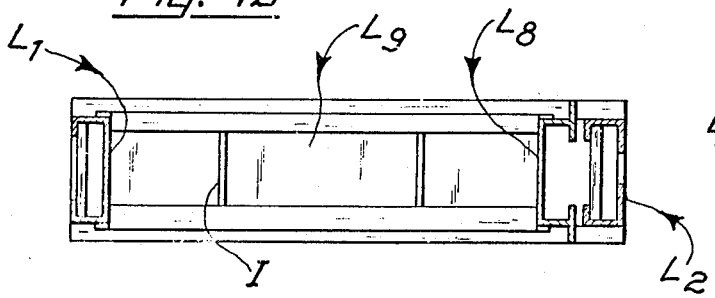
Figure 4C:
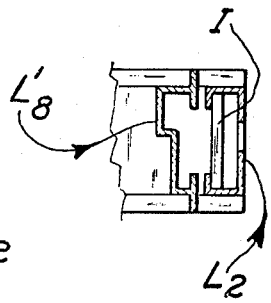
FIG. 4*c* is a detail view of a variation of FIG. 4*b*.
Figure 5:
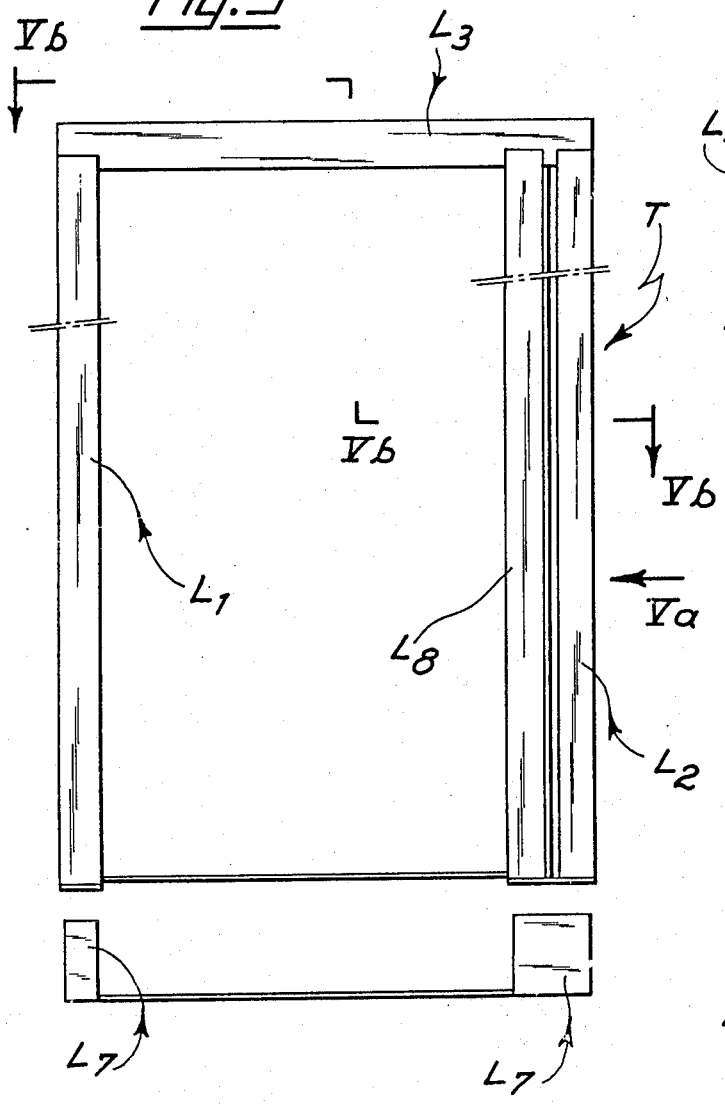
FIGS. 5, 5*a*, 5*b* are views similar to FIGS. 4, 4*a*, 4*b*, but illustrate a different embodiment of the frame, in this case consisting of just three elements, which can be used when the subframe on the outside of the building consists of a door with a balcony, hence the bottom horizontal member is omitted.
Figure 5A:
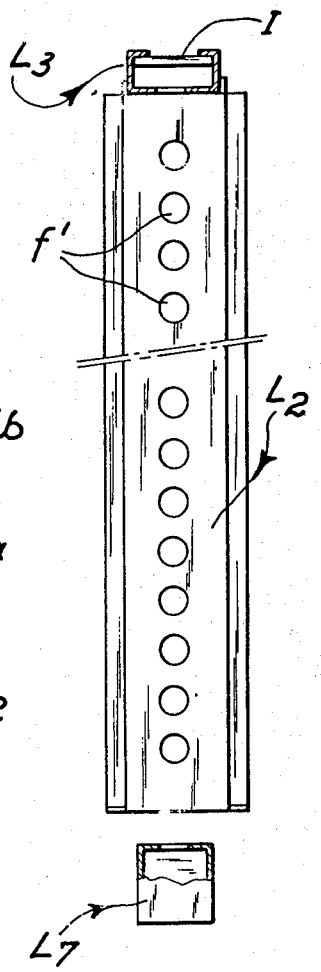
Figure 5B:
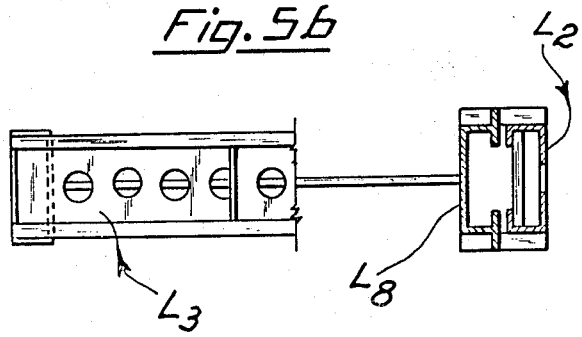
Figure 5C:
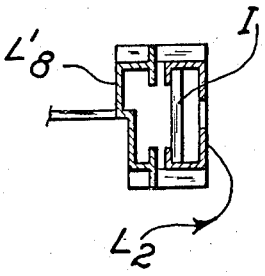
FIG. 5*c* is a view similar to FIG. 4*c*, but is a detail view of a variation of FIG. 5*b*.

In FIGS. 1*b* and 1*c* the letters $L_5$ and $L_6$ designate characteristic Z section or Z-shaped reinforcements serving for determining positioning and fastening of external cladding panels $L_7$ designates a likewise characteristic element for anchoring frame T to foundation level and which is conveniently accommodated in the cavity of member $L_4$, wherein for such purposes, member $L_4$ can be formed as a C channel section having three sides equal in length.

Figure 6:
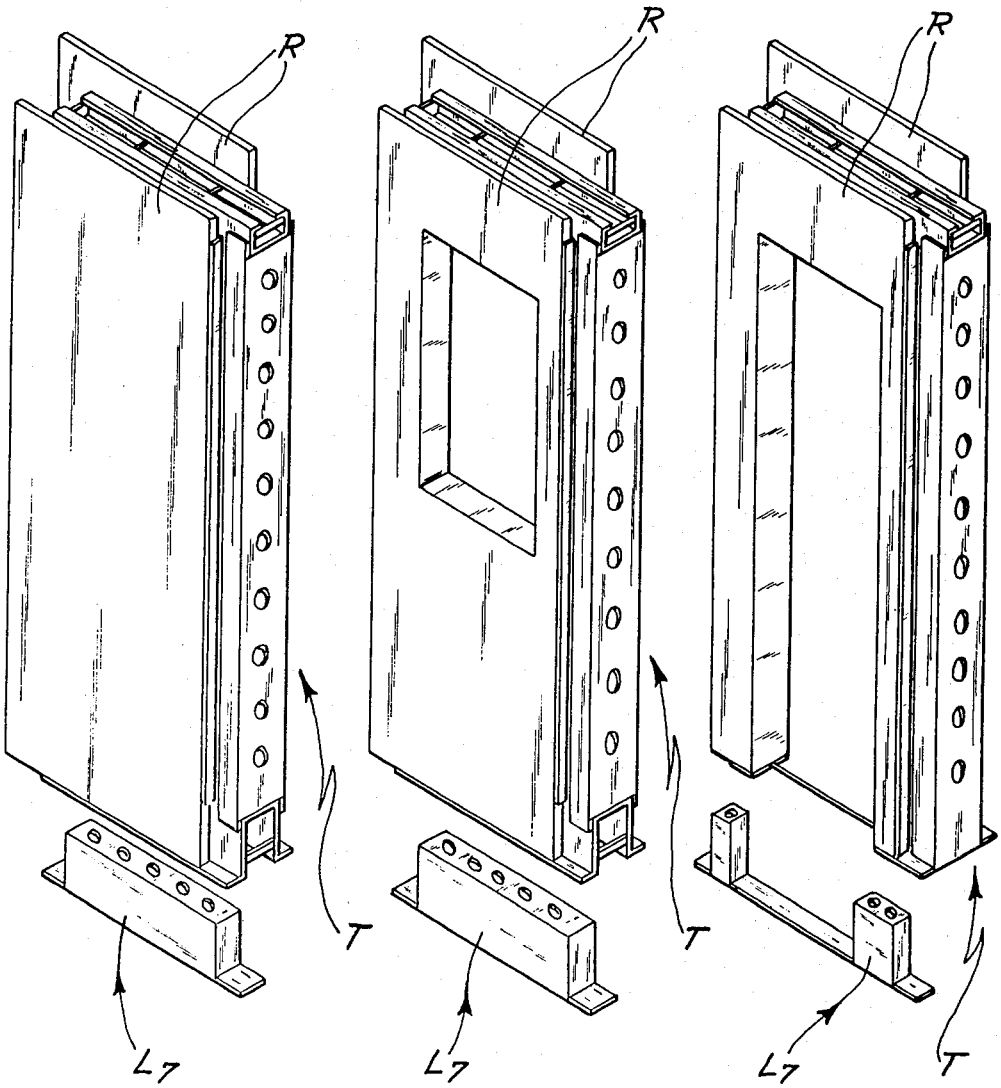
FIG. 6 is an exploded perspective side view of the frames illustrated in FIGS. 1, 4 and 5.

The different configurations and embodiments which can be assumed by member $L_7$ are clearly visible in FIG. 6.

As stated previously, FIGS. 4, 4*a*, 4*b* and 4*c* illustrate a variation of the frame which can have more than four members. Additional members are designated by $L_8$ for a vertical member and by $L_9$ for a horizontal member. $L'_8$ (FIG. 4*c*) corresponds to a structural section of special form depending on the overall dimensions of the subframe (window) for which frame T serves.

In FIGS. 5, 5*a*, 5*b* and 5*c* in which yet another embodiment of the frame is illustrated, there is only one extra member, i.e. a vertical member, likewise designated by $L_8$.

Each of the members $L_1$, $L_2$, $L_3$, $L_4$, $L_8$, $L_9$, has a C-shaped channel section and, as already stated, can be made of sheet metal or glass fibre reinforced plastic.

Each of the shorter sides or flanges of such C-shaped channel terminates, for the purposes of improved rigidity, with portions bent by 90° towards the inside of the C-shaped channel section in order to stiffen such sides (see, for example, FIGS. 1*b*, 2*b*, 3*b*, 4*b*) apart from members $L_4$ which have such portions bent by 90° towards the outside of the C-shaped channel section in order to support the external cladding panels R (see FIG. 6).

Furthermore, all members can be provided with a series of equidistant angle stiffeners I which extend at right angles to the shorter sides of the respected C-shaped channel section and which are spot welded to such sides (see FIG. 1*a*).

Moreover, the wider side of web of vertical member $L_2$ and the shorter sides of vertical members $L_5$, $L_6$ are without terminal end portions, i.e. they are cut away at Y and Y', respectively, in order to facilitate welding of such members (see FIG. 1*c*).

The wider sides of said the C-shaped channel section members are designated by $L'_1$, $L'_2$, $L'_3$, $L'_4$, $L'_8$, $L'_9$, and are drilled with holes f normally equidistant over the entire surface. The shorter sides of such members are designated by $L''_1$, $L''_2$, $L''_3$, $L''_4$, $L''_8$, $L''_9$, and are not drilled.

The variations in FIGS. 2*b*, 3*b* differ in that they are also provided with rectangular holes f, through which can extend pilasters P, either in addition to or in place of various holes f'.

Through holes f', it is possible to introduce various materials into the interior of any of the frames T, such as concrete (lightweight or otherwise), expanded clay, polyurethane, or any type of filling or insulating material such as glass wool, cork, asbestos cement, polyvinyl chloride or other such materials.

Cladding panels R or any type of material can be fastened to the outside of any one of the frames T by means of adhesive, rivetting or other systems.

The characteristic Z-shaped section reinforcements $L_5$ and $L_6$, described above, are provided for facilitating this fastening of the cladding panels R.

Members $L_1$, $L_3$ and $L_4$ of each frame T have their shorter sides $L''_1$, $L''_3$, $L''_4$ extending outwardly from the center of the frame T. Members $L_2$ have sides $L''_2$ facing towards the inside of the frame. Hence the various adjacent frames T can be easily joined together so as to build up the external walls of a building (see FIG. 1*c*).

Thus frames T constitute the encasement and at the same time form an irremovable component of an external wall.

As frames T are factory produced and are therefore available as ready prepared at the building site, construction of the external walls is very greatly facilitated, and is more reliable and rapid than in the past. Above all, it should be emphasized that with the process in accordance with the invention, substantially any structural, predimensioning, curtain walling, heat and sound insulation problems can be solved. Hence the planner's job will be essentially related to aesthetic considerations as it is guaranteed from the economic point-of-view.

With this system, not only can any portion of an external wall be obtained, but it is also possible to obtain internal walls or partitions, whether they incorporate/do not incorporate various service installations.

Any one skilled in the art can easily deduce that numerous variations can be effected to the process in accordance with the invention and to the frames obtainable therewith, which are herein described as an exemplification of the invention and are not intended to limit the invention. Such variations all fall within the true spirit and scope of the invention, which is defined by the following appended claims.

I claim:

1. A frame having an inner face and an outer face for use as a portion of an external wall of a building, constructed by assembling and encasing a plurality of such frames, said frame comprising:

an upper horizontal C-shaped section channel member and first and second vertical C-shaped section channel members;

each said C-shaped section channel member including a pair of spaced flanges joined by a web, with end portions of said flanges opposite said web being bent inwardly toward each other to define a mouth;

said C-shaped section channel members being rigidly assembled with said first vertical member extending vertically downwardly from a first end of said horizontal member and with said mouth of said first vertical member facing inwardly of said frame, with said second vertical member extending vertically downwardly from said horizontal member at a position spaced longitudinally thereof from said first vertical member and with said mouth of said second vertical member facing outwardly of said frame, and with said mouth of said horizontal member facing upwardly;

vertically spaced stiffener members positioned between and fixed to said spaced flanges of said vertical members, said stiffener members extending substantially at right angles to the respective said spaced flanges;

cladding panels positioned on said inner and outer faces of said frame, each said cladding panel having vertical side edges between a front side and a back side; and a pair of Z-shaped section members extending vertically downwardly from and fixed to said horizontal member at a position adjacent said first vertical member and inwardly thereof, each said Z-shaped member having a flange extending outwardly from said inner and outer faces of said frame and having opposite inside and outside vertical surfaces forming means for supporting and positioning said vertical side edges of said cladding panels to cover said inner and outer faces of said frame.

2. A frame as claimed in claim 1, further comprising a plurality of spaced holes formed in said webs of each of said C-shaped section channel members, thereby forming means for the supply of filling or insulating material into the interior of said frame.

3. A frame as claimed in claim 1, further comprising a lower horizontal C-shaped section channel member fixed to bottom ends of said first and second vertical members and said Z-shaped members, said lower horizontal member including a pair of spaced flanges joined by a web, with end portions of said flanges opposite said web being bent outwardly away from each other and forming means for supporting bottom edges of the cladding panels, said lower horizontal member being positioned with said web thereof facing upwardly.

4. A frame as claimed in claim 3, wherein said flanges and said web of said lower horizontal member are of equal cross-sectional dimension and define a downwardly open cavity, and further comprising a horizontal anchoring member having a shape complementary to and fitting into said cavity, with complementary surfaces of said anchoring member and said lower horizontal member substantially being in planar contact.

5. A frame as claimed in claim 3, wherein said upper and lower horizontal members have therein vertical, generally rectangular holes for passage through said frame of a pillar of the building.

6. A frame as claimed in claim 3, wherein each said cladding panel has its vertical side edge abutting said inside vertical surface of said flange of said Z-shaped member, a lower edge abutting a said outwardly facing end portion of a respective said flange of said lower horizontal member, and an upper edge extending above said upper horizontal member.

7. A frame as claimed in claim 3, wherein said second vertical member is fixed to said upper and lower horizontal members at positions spaced inwardly of said frame from ends of said horizontal members opposite to said first vertical member, and the side of said frame opposite said first vertical member is open.

8. A frame as claimed in claim 1, wherein the bottom of said frame opposite said upper horizontal member is open.

9. A frame as claimed in claim 1, further comprising additional horizontal and vertical members defining a subframe for a window or a door.

10. A process for manufacturing a frame having an inner face and an outer face portion of an external wall of a building, constructed by assembling and encasing a plurality of such frames, said process comprising:

providing an upper horizontal C-shaped section channel member and first and second C-shaped section channel members, with each said C-shaped section channel member including a pair of spaced flanges joined by a web, with end portions of said flanges opposite said web being bent inwardly toward each other to define a mouth;

rigidly assembling said C-shaped section channel members with said first vertical member extending vertically downwardly from a first end of said horizontal member and with said mouth of said first vertical member facing inwardly of said frame, with said second vertical member extending vertically downwardly from said horizontal member at a position spaced longitudinally thereof from said first vertical member and with said mouth of said second vertical member facing outwardly of said frame, and with said mouth of said horizontal member facing upwardly;

vertically spacing and fixing stiffening members to said spaced flanges of said vertical members, with each said stiffener member extending between respective said spaced flanges at substantially right angles thereto;

positioning cladding panels on said inner and outer faces of said frame, each said cladding panel having vertical side edges between a front side and a back side;

providing a pair of Z-shaped section members, each including a web having flanges extending in opposite directions from opposite ends thereof; and fixing said pair of Z-shaped members to said horizontal member to extend vertically downwardly therefrom at a position adjacent said first vertical member and inwardly therefrom, with one of said flanges of each said Z-shaped member extending outwardly from said inner and outer faces of said frame and having opposite inside and outside vertical surfaces forming means for supporting and positioning said vertical side edges of said cladding panels to cover said inner and outer faces of said frame.

11. A process as claimed in claim 10, further comprising forming a plurality of spaced holes in said webs of each of said C-shaped section channel members, and thereby providing means for the supply of filling or insulating material into the interior of said frame.

12. A process as claimed in claim 10, further comprising providing a lower horizontal C-shaped section channel member including a pair of spaced flanges joined by a web, with end portions of said flanges opposite said web being bent outwardly away from each other and thereby forming means for supporting bottom edges of the cladding panels, and fixing said lower horizonal member to bottom ends of said first and second vertical members and said Z-shaped member, with said web of said lower horizontal member facing upwardly.

13. A process as claimed in claim 12, further comprising fitting a horizontal anchoring member into a cavity formed in the bottom of said lower horizontal member, with said anchoring member and said lower horizontal member having complementary surfaces substantially in planar contact.

14. A process as claimed in claim 12, further comprising forming vertical, generally rectangular holes in said upper and lower horizontal members for passage through said frame of a pillar of the building.

15. A process as claimed in claim 12, further comprising positioning said vertical side edge of each said cladding panel abutting said inside vertical surface of said flange of said Z-shaped member, with a lower edge of each said cladding panel abutting said outwardly facing end portion of said flange of said lower horizontal member, and with an upper edge of each said cladding panel extending above said upper horizontal member.

16. A process as claimed in claim 12, comprising fixing said second vertical member to said upper and lower horizontal members at positions spaced inwardly of said frame from ends of said horizontal members opposite to said first vertical member, and maintaining open the side of said frame opposite said first vertical member.

17. A process as claimed in claim 10, further comprising maintaining open the bottom of said frame opposite said upper horizontal member.

18. A process as claimed in claim 10, further comprising fixing additional horizontal and vertical members, and thereby defining a subframe for a window or a door.

* * * * *